US007963048B2

(12) United States Patent
Pollard

(10) Patent No.: US 7,963,048 B2
(45) Date of Patent: Jun. 21, 2011

(54) DUAL PATH KILN

(76) Inventor: Levi A. Pollard, Appling, GA (US)

( * ) Notice: Subject to any disclaimer, the term of this patent is extended or adjusted under 35 U.S.C. 154(b) by 97 days.

(21) Appl. No.: 11/525,929

(22) Filed: Sep. 25, 2006

(65) Prior Publication Data

US 2007/0044341 A1 Mar. 1, 2007

Related U.S. Application Data

(63) Continuation-in-part of application No. 11/414,262, filed on May 1, 2006, now abandoned.

(51) Int. Cl.
*F26B 11/00* (2006.01)

(52) U.S. Cl. ..... 34/396; 34/506; 34/479; 34/381; 34/406; 252/70; 241/19; 432/247; 110/315; 62/304; 705/14

(58) Field of Classification Search ..... 34/396, 34/201, 506, 479, 381, 406; 705/14; 241/19; 110/315; 252/70; 62/304; 432/247
See application file for complete search history.

(56) References Cited

U.S. PATENT DOCUMENTS

| | | | | | |
|---|---|---|---|---|---|
| 997,092 | A | * | 7/1911 | Reyscher | 34/506 |
| 1,328,661 | A | * | 1/1920 | Fish, Jr | 34/350 |
| 1,366,225 | A | * | 1/1921 | Weiss | 34/396 |
| 1,413,018 | A | * | 4/1922 | Kakuji | 427/254 |
| 1,593,598 | A | * | 7/1926 | Redman | 34/396 |
| 1,953,193 | A | * | 4/1934 | Sampson | 34/396 |
| 2,060,111 | A | * | 11/1936 | Phillips et al. | 34/221 |
| 2,185,760 | A | * | 1/1940 | Altenkirch | 34/396 |
| 2,202,143 | A | * | 5/1940 | Forrest | 34/474 |
| 2,237,255 | A | * | 4/1941 | Finnegan | 62/63 |
| 2,288,154 | A | * | 6/1942 | Fornest | 34/475 |
| 2,363,294 | A | * | 11/1944 | Carrier | 165/217 |
| 2,363,945 | A | * | 11/1944 | Carrier | 165/214 |
| 2,383,504 | A | * | 8/1945 | Luckhaupt | 427/315 |
| 2,397,993 | A | * | 4/1946 | Urquhart | 75/481 |
| 2,408,434 | A | * | 10/1946 | Mann et al. | 34/256 |
| 2,425,660 | A | * | 8/1947 | Ware, Jr. et al. | 156/85 |
| 2,463,782 | A | * | 3/1949 | Leischner | 34/396 |
| 2,519,340 | A | * | 8/1950 | Bailey | 48/197 R |
| 2,521,554 | A | * | 9/1950 | Ware, Jr. et al. | 156/83 |
| 2,527,782 | A | * | 10/1950 | Williams | 62/314 |
| 2,529,366 | A | * | 11/1950 | Bauer | 432/15 |
| 2,575,426 | A | * | 11/1951 | Parnell | 426/241 |
| 2,593,709 | A | * | 4/1952 | Ware, Jr. et al. | 242/560.3 |
| 2,603,004 | A | * | 7/1952 | Quimby et al. | 34/396 |
| 2,687,192 | A | * | 8/1954 | Butterfield | 188/264 W |
| 2,706,344 | A | * | 4/1955 | Vaughan | 34/495 |
| 2,717,825 | A | * | 9/1955 | Greenawalt | 422/205 |
| 2,834,120 | A | * | 5/1958 | Russell | 34/476 |
| 2,860,070 | A | * | 11/1958 | McDonald | 427/297 |
| 2,892,261 | A | * | 6/1959 | Hutchinson | 34/351 |
| 2,956,933 | A | * | 10/1960 | Jolin | 201/36 |
| 2,992,152 | A | * | 7/1961 | Chapman | 162/103 |

(Continued)

FOREIGN PATENT DOCUMENTS

| | | | |
|---|---|---|---|
| CH | 677527 | A * | 5/1991 |

(Continued)

*Primary Examiner* — Stephen M. Gravini
(74) *Attorney, Agent, or Firm* — Jeffrey S. Melcher; Manelli Denison & Selter PLLC

(57) ABSTRACT

An dual path kiln is provided that includes a kiln having one or more chambers and at least two lumber charge paths adapted to convey lumber through the kiln in opposite directions.

23 Claims, 3 Drawing Sheets

U.S. PATENT DOCUMENTS

| | | | | | |
|---|---|---|---|---|---|
| 3,002,877 | A | * | 10/1961 | McDonald | 162/74 |
| 3,061,878 | A | * | 11/1962 | Chapman | 425/339 |
| 3,090,130 | A | * | 5/1963 | Smith | 34/557 |
| 3,196,554 | A | * | 7/1965 | Smith | 34/557 |
| 3,199,213 | A | * | 8/1965 | Milligan et al. | 34/396 |
| 3,233,097 | A | * | 2/1966 | Watkins | 246/428 |
| 3,234,659 | A | * | 2/1966 | Smith | 34/475 |
| 3,262,216 | A | * | 7/1966 | Dugger, Sr | 34/475 |
| 3,269,136 | A | * | 8/1966 | Umano | 62/123 |
| 3,307,529 | A | * | 3/1967 | Fannon, Jr. et al. | 126/92 B |
| 3,324,939 | A | * | 6/1967 | Laing | 165/122 |
| 3,337,967 | A | * | 8/1967 | Smith | 34/537 |
| 3,449,116 | A | * | 6/1969 | Derham | 75/10.3 |
| 3,470,623 | A | * | 10/1969 | Hildebrand | 34/396 |
| 3,529,358 | A | * | 9/1970 | Robinson | 34/494 |
| 3,545,094 | A | * | 12/1970 | Barnes et al. | 34/396 |
| 3,571,943 | A | * | 3/1971 | Sipple | 34/342 |
| 3,574,949 | A | * | 4/1971 | Farnsworth | 34/407 |
| 3,589,313 | A | * | 6/1971 | Smith et al. | 110/222 |
| 3,680,219 | A | * | 8/1972 | Koch | 34/396 |
| 3,714,716 | A | * | 2/1973 | Dedrick | 4/495 |
| 3,721,013 | A | * | 3/1973 | Miller | 34/265 |
| 3,741,890 | A | * | 6/1973 | Smith et al. | 210/667 |
| 3,744,147 | A | * | 7/1973 | Pless | 34/259 |
| 3,757,428 | A | * | 9/1973 | Runciman | 34/340 |
| 3,782,000 | A | * | 1/1974 | Pless | 34/345 |
| 3,818,601 | A | * | 6/1974 | Cooper et al. | 34/396 |
| 3,861,150 | A | * | 1/1975 | Lear | 60/670 |
| 3,902,253 | A | * | 9/1975 | Sabuzawa et al. | 34/256 |
| 3,913,351 | A | * | 10/1975 | Edwards | 62/402 |
| 3,933,128 | A | * | 1/1976 | Cramer | 122/4 R |
| 3,939,573 | A | * | 2/1976 | Berti | 34/471 |
| 3,945,331 | A | * | 3/1976 | Drake et al. | 110/190 |
| 3,967,466 | A | * | 7/1976 | Edwards | 62/402 |
| 3,986,268 | A | * | 10/1976 | Koppelman | 34/257 |
| 4,017,980 | A | * | 4/1977 | Kleinguenther | 34/396 |
| 4,031,631 | A | * | 6/1977 | Robinson | 34/235 |
| 4,033,113 | A | * | 7/1977 | Cramer | 60/772 |
| 4,071,637 | A | * | 1/1978 | Dittrich et al. | 234/2 |
| 4,106,215 | A | * | 8/1978 | Rosen | 34/217 |
| 4,111,744 | A | * | 9/1978 | Reiniger | 162/100 |
| 4,121,350 | A | * | 10/1978 | Buchholz | 34/77 |
| 4,122,356 | A | * | 10/1978 | Decker | 290/52 |
| 4,148,356 | A | * | 4/1979 | Cramer | 165/111 |
| 4,169,583 | A | * | 10/1979 | Cramer | 266/122 |
| 4,176,466 | A | * | 12/1979 | Pagnozzi et al. | 34/233 |
| 4,182,048 | A | * | 1/1980 | Wolfe et al. | 34/396 |
| 4,194,296 | A | * | 3/1980 | Pagnozzi et al. | 34/410 |
| 4,196,526 | A | * | 4/1980 | Berti | 34/77 |
| 4,212,635 | A | * | 7/1980 | North | 432/239 |
| 4,213,947 | A | * | 7/1980 | Fremont et al. | 423/245.3 |
| 4,228,783 | A | * | 10/1980 | Kalenian | 126/112 |
| 4,233,024 | A | * | 11/1980 | Plass | 432/72 |
| 4,261,110 | A | * | 4/1981 | Northway et al. | 34/396 |
| 4,280,878 | A | * | 7/1981 | Sprenger | 202/93 |
| 4,298,560 | A | * | 11/1981 | Plass | 264/629 |
| 4,343,607 | A | * | 8/1982 | Coleman | 432/18 |
| 4,348,211 | A | * | 9/1982 | Zimmerman | 48/76 |
| 4,357,758 | A | * | 11/1982 | Lampinen | 34/331 |
| 4,378,640 | A | * | 4/1983 | Buchholz | 34/632 |
| 4,399,619 | A | * | 8/1983 | Martin | 34/611 |
| 4,403,948 | A | * | 9/1983 | Waldmann et al. | 432/1 |
| 4,416,069 | A | * | 11/1983 | Rosen et al. | 34/380 |
| 4,420,299 | A | * | 12/1983 | De Mets | 425/101 |
| 4,432,147 | A | * | 2/1984 | Chen et al. | 34/542 |
| 4,445,559 | A | * | 5/1984 | Coleman | 144/363 |
| 4,445,910 | A | * | 5/1984 | Zimmerman | 48/76 |
| 4,455,837 | A | * | 6/1984 | Firey | 60/670 |
| 4,466,198 | A | * | 8/1984 | Doll | 34/257 |
| 4,467,532 | A | * | 8/1984 | Drake | 34/407 |
| 4,468,256 | A | * | 8/1984 | Hinger | 127/1 |
| 4,484,531 | A | * | 11/1984 | Firey | 110/342 |
| 4,490,926 | A | * | 1/1985 | Stokes | 34/76 |
| 4,495,165 | A | * | 1/1985 | Gurza | 423/321.1 |
| 4,497,637 | A | * | 2/1985 | Purdy et al. | 48/111 |
| 4,501,205 | A | * | 2/1985 | Funk | 110/347 |
| 4,530,700 | A | * | 7/1985 | Sawyer et al. | 44/606 |
| 4,545,360 | A | * | 10/1985 | Smith et al. | 126/76 |
| 4,554,076 | A | * | 11/1985 | Speaker | 210/639 |
| 4,559,882 | A | * | 12/1985 | Dobson | 110/254 |
| 4,561,261 | A | * | 12/1985 | Kornrumpf et al. | 62/126 |
| 4,564,368 | A | * | 1/1986 | Sawyer et al. | 44/606 |
| 4,580,354 | A | * | 4/1986 | Lindberg | 34/486 |
| 4,620,373 | A | * | 11/1986 | Laskowski et al. | 34/406 |
| 4,621,503 | A | * | 11/1986 | Woods et al. | 62/228.3 |
| 4,663,860 | A | * | 5/1987 | Beall | 34/396 |
| 4,675,029 | A | * | 6/1987 | Norman et al. | 95/73 |
| 4,722,322 | A | * | 2/1988 | Varney et al. | 126/261 |
| 4,771,708 | A | * | 9/1988 | Douglass, Jr. | 110/233 |
| 4,781,778 | A | * | 11/1988 | Olofsson | 156/196 |
| 4,862,599 | A | * | 9/1989 | Brunner | 34/536 |
| 4,908,104 | A | * | 3/1990 | Loomans et al. | 201/25 |
| 4,922,624 | A | * | 5/1990 | Tharpe | 34/475 |
| RE33,273 | E | * | 7/1990 | Speaker | 210/639 |
| 4,941,521 | A | * | 7/1990 | Redekop et al. | 144/347 |
| 5,017,269 | A | * | 5/1991 | Loomans et al. | 201/25 |
| 5,059,404 | A | * | 10/1991 | Mansour et al. | 423/201 |
| 5,062,372 | A | * | 11/1991 | Ritter | 110/242 |
| 5,171,613 | A | * | 12/1992 | Bok et al. | 427/422 |
| 5,188,740 | A | * | 2/1993 | Khan | 210/770 |
| 5,240,656 | A | * | 8/1993 | Scheeres | 264/297.1 |
| 5,243,963 | A | * | 9/1993 | Riener | 126/107 |
| 5,256,255 | A | * | 10/1993 | Fagerlund | 162/237 |
| 5,263,266 | A | * | 11/1993 | Schmidt | 34/478 |
| 5,269,076 | A | * | 12/1993 | Breckenridge | 34/413 |
| 5,271,340 | A | * | 12/1993 | Whitney | 110/346 |
| 5,279,712 | A | * | 1/1994 | Constantine | 201/37 |
| 5,293,700 | A | * | 3/1994 | Ishii | 34/225 |
| 5,297,957 | A | * | 3/1994 | Brashears | 432/14 |
| 5,306,481 | A | * | 4/1994 | Mansour et al. | 423/652 |
| 5,325,604 | A | * | 7/1994 | Little | 34/493 |
| 5,345,695 | A | * | 9/1994 | Graham | 34/94 |
| 5,363,780 | A | * | 11/1994 | Whitney | 110/346 |
| 5,399,039 | A | * | 3/1995 | Giles et al. | 400/636 |
| 5,406,316 | A | * | 4/1995 | Schwiebert et al. | 347/18 |
| 5,406,321 | A | * | 4/1995 | Schwiebert et al. | 347/102 |
| 5,413,746 | A | * | 5/1995 | Birjukov | 264/118 |
| 5,416,985 | A | * | 5/1995 | Culp | 34/487 |
| 5,425,182 | A | * | 6/1995 | Brunner | 34/66 |
| 5,454,426 | A | * | 10/1995 | Moseley | 165/136 |
| 5,461,408 | A | * | 10/1995 | Giles et al. | 347/102 |
| 5,479,199 | A | * | 12/1995 | Moore et al. | 347/102 |
| 5,500,667 | A | * | 3/1996 | Schwiebert et al. | 347/102 |
| 5,534,437 | A | * | 7/1996 | Arrau | 435/290.3 |
| 5,536,488 | A | * | 7/1996 | Mansour et al. | 423/652 |
| 5,557,858 | A | * | 9/1996 | Macaluso et al. | 34/273 |
| 5,581,289 | A | * | 12/1996 | Firl et al. | 347/104 |
| 5,595,000 | A | * | 1/1997 | Goodwin, III | 34/471 |
| 5,606,859 | A | * | 3/1997 | Ploshkin | 60/669 |
| 5,633,668 | A | * | 5/1997 | Schwiebert et al. | 347/102 |
| 5,637,192 | A | * | 6/1997 | Mansour et al. | 162/29 |
| 5,641,273 | A | * | 6/1997 | Moseley | 417/205 |
| 5,678,324 | A | * | 10/1997 | Viitaniemi et al. | 34/396 |
| 5,685,153 | A | * | 11/1997 | Dickinson et al. | 60/648 |
| 5,687,490 | A | * | 11/1997 | Harrison | 34/92 |
| 5,704,134 | A | * | 1/1998 | Carter et al. | 34/396 |
| 5,758,434 | A | * | 6/1998 | Gipson | 34/340 |
| 5,770,267 | A | * | 6/1998 | Bullock, Jr. | 427/356 |
| 5,784,805 | A | * | 7/1998 | Hashimoto | 34/589 |
| 5,788,865 | A | * | 8/1998 | Smirnov et al. | 210/690 |
| 5,797,332 | A | * | 8/1998 | Keller et al. | 110/226 |
| 5,815,945 | A | * | 10/1998 | Ando | 34/269 |
| 5,836,086 | A | * | 11/1998 | Elder | 34/396 |
| 5,851,246 | A | * | 12/1998 | Bishop et al. | 48/122 |
| 5,851,309 | A | * | 12/1998 | Kousa | 136/248 |
| 5,852,880 | A | * | 12/1998 | Harrison | 34/92 |
| 5,873,182 | A | * | 2/1999 | Fuller | 34/527 |
| 5,878,509 | A | * | 3/1999 | Burnett | 34/557 |
| 5,899,004 | A | * | 5/1999 | Sugaoka et al. | 34/396 |
| 5,901,463 | A | * | 5/1999 | Guyonnet | 34/396 |
| 5,915,811 | A | * | 6/1999 | DeVore et al. | 34/93 |
| 5,926,968 | A | * | 7/1999 | Gipson | 34/77 |
| 5,940,984 | A | * | 8/1999 | Moren | 34/396 |
| 5,964,985 | A | * | 10/1999 | Wootten | 201/40 |
| 5,966,837 | A | * | 10/1999 | Backa et al. | 34/469 |
| 5,970,624 | A | * | 10/1999 | Moriya | 34/411 |
| 5,979,074 | A | * | 11/1999 | Brunner et al. | 34/396 |

5,992,047 A * 11/1999 Fuller ..... 34/495
5,992,048 A * 11/1999 DeVore et al. ..... 34/522
6,013,158 A * 1/2000 Wootten ..... 202/99
6,014,819 A * 1/2000 Elder ..... 34/396
6,024,226 A * 2/2000 Olivier ..... 209/172.5
RE36,728 E * 6/2000 Ishii ..... 34/396
6,105,278 A * 8/2000 Gerrish et al. ..... 34/497
6,108,941 A * 8/2000 Gillespy ..... 34/619
6,110,316 A * 8/2000 Kobayashi et al. ..... 156/230
6,112,677 A * 9/2000 Kuntschar et al. ..... 110/315
6,119,364 A * 9/2000 Elder ..... 34/212
6,138,379 A * 10/2000 DeVore et al. ..... 34/395
6,141,888 A * 11/2000 Cammarata ..... 34/536
6,149,765 A * 11/2000 Mansour et al. ..... 162/29
6,219,937 B1 * 4/2001 Culp et al. ..... 34/396
6,233,545 B1 * 5/2001 Datig ..... 704/2
6,243,970 B1 * 6/2001 Culp et al. ..... 34/508
6,248,985 B1 * 6/2001 Tomasello ..... 219/679
6,293,121 B1 * 9/2001 Labrador ..... 62/304
6,327,994 B1 * 12/2001 Labrador ..... 114/382
6,341,372 B1 * 1/2002 Datig ..... 717/136
6,344,638 B1 * 2/2002 Tomasello ..... 219/770
6,345,450 B1 * 2/2002 Elder ..... 34/396
6,348,679 B1 * 2/2002 Ryan et al. ..... 219/634
6,355,904 B1 * 3/2002 Batdorf et al. ..... 219/121.59
6,370,792 B1 * 4/2002 Culp et al. ..... 34/78
6,379,929 B1 * 4/2002 Burns et al. ..... 435/91.2
6,381,871 B2 * 5/2002 Uehara ..... 34/446
6,393,723 B1 * 5/2002 Nagel ..... 34/201
6,393,727 B1 * 5/2002 Seelig et al. ..... 34/396
6,467,190 B2 * 10/2002 Nagel et al. ..... 34/218
6,467,300 B1 * 10/2002 Noble, III ..... 62/472
6,473,994 B1 * 11/2002 Dedieu et al. ..... 34/396
6,551,457 B2 * 4/2003 Westman et al. ..... 162/158
6,553,688 B1 * 4/2003 Lee ..... 34/398
6,574,979 B2 * 6/2003 Faqih ..... 62/285
6,600,142 B2 * 7/2003 Ryan et al. ..... 219/634
6,617,557 B1 * 9/2003 Ryan et al. ..... 219/634
6,640,462 B1 * 11/2003 Choi et al. ..... 34/406
6,649,888 B2 * 11/2003 Ryan et al. ..... 219/634
6,652,274 B2 * 11/2003 Nagel et al. ..... 432/247
6,667,429 B2 * 12/2003 Abe et al. ..... 84/1
6,675,495 B2 * 1/2004 Dedieu et al. ..... 34/245
6,680,456 B2 * 1/2004 Adams ..... 219/121.47
6,684,648 B2 * 2/2004 Faqih ..... 62/93
6,725,566 B1 * 4/2004 Skrotsky et al. ..... 34/396
6,729,043 B2 * 5/2004 Muhlbock ..... 34/491
6,742,278 B2 * 6/2004 Vinden et al. ..... 34/259
6,742,283 B2 * 6/2004 Ishii ..... 34/479
6,772,535 B2 * 8/2004 Koslow ..... 34/380
6,796,476 B2 * 9/2004 Birk et al. ..... 227/2
6,817,556 B2 * 11/2004 Hesch ..... 241/19
6,865,821 B2 * 3/2005 Merschat ..... 34/403
6,868,690 B2 * 3/2005 Faqih ..... 62/291
6,969,409 B2 * 11/2005 Ichimura et al. ..... 8/128.1
7,028,478 B2 * 4/2006 Prentice, III ..... 60/645
7,043,853 B2 * 5/2006 Roberts et al. ..... 34/73
7,044,429 B1 * 5/2006 Foreman et al. ..... 249/205
7,089,685 B2 * 8/2006 Torgovnikov et al. ..... 34/265
7,135,332 B2 * 11/2006 Ouellette ..... 435/290.1
7,146,747 B2 * 12/2006 Studd et al. ..... 34/396
7,169,489 B2 * 1/2007 Redmond ..... 429/515
7,178,263 B2 * 2/2007 Asano et al. ..... 34/357
7,178,941 B2 * 2/2007 Roberge et al. ..... 362/225
7,220,365 B2 * 5/2007 Qu et al. ..... 252/70
7,226,675 B2 * 6/2007 Ovshinsky et al. ..... 429/9
7,241,322 B2 * 7/2007 Graham ..... 48/111
7,246,452 B1 * 7/2007 Roy ..... 34/396
7,248,942 B2 * 7/2007 Bash et al. ..... 700/213
7,281,561 B2 * 10/2007 Anderson et al. ..... 160/121.1
7,337,554 B2 * 3/2008 Erickson ..... 34/396
7,370,434 B2 * 5/2008 Duncan ..... 34/218
7,473,551 B2 * 1/2009 Warthoe ..... 435/287.2
7,498,009 B2 * 3/2009 Leach et al. ..... 423/235
7,511,443 B2 * 3/2009 Townsend et al. ..... 318/568.2
7,523,603 B2 * 4/2009 Hagen et al. ..... 60/39.55
7,589,883 B2 * 9/2009 Varaprasad et al. ..... 359/267
7,612,735 B2 * 11/2009 Essig et al. ..... 343/915
7,624,801 B2 * 12/2009 Zubrin et al. ..... 166/250.15
7,637,030 B2 * 12/2009 Sugawara et al. ..... 34/93
7,638,070 B2 * 12/2009 Johnson et al. ..... 252/373
7,643,200 B2 * 1/2010 Varaprasad et al. ..... 359/267
7,650,939 B2 * 1/2010 Zubrin et al. ..... 166/266
7,676,953 B2 * 3/2010 Magill ..... 34/282
7,683,126 B2 * 3/2010 Neal et al. ..... 525/56
7,685,819 B2 * 3/2010 Vetrovec ..... 60/611
7,690,148 B2 * 4/2010 Hedman ..... 43/132.1
7,694,688 B2 * 4/2010 Lester et al. ..... 134/62
7,700,027 B2 * 4/2010 Neal et al. ..... 264/283
7,703,301 B2 * 4/2010 Loibl et al. ..... 62/376
7,707,848 B2 * 5/2010 Loibl et al. ..... 62/376
7,732,039 B2 * 6/2010 Chakravarty et al. ..... 428/174
7,744,671 B1 * 6/2010 Ouellette ..... 71/9
7,752,845 B2 * 7/2010 Johnson ..... 60/645
7,761,954 B2 * 7/2010 Ziegler et al. ..... 15/320
7,810,565 B2 * 10/2010 Zubrin et al. ..... 166/266
7,821,697 B2 * 10/2010 Varaprasad et al. ..... 359/267
7,841,282 B2 * 11/2010 Kimberlin et al. ..... 110/101 C
7,854,631 B2 * 12/2010 Townsendl et al. ..... 439/620.01
7,855,755 B2 * 12/2010 Weller et al. ..... 349/11
7,857,995 B2 * 12/2010 Johnson et al. ..... 252/373
7,893,644 B2 * 2/2011 Townsend et al. ..... 318/565
7,906,695 B2 * 3/2011 Giercke ..... 585/240
2001/0001218 A1 * 5/2001 Luongo ..... 264/42
2002/0002208 A1 * 1/2002 Martel et al. ..... 521/45.5
2002/0030721 A1 * 3/2002 Asakawa et al. ..... 347/65
2002/0108266 A1 * 8/2002 Nagel et al. ..... 34/223
2003/0029052 A1 * 2/2003 Nagel et al. ..... 34/201
2003/0066638 A1 * 4/2003 Qu et al. ..... 165/186
2003/0115771 A1 * 6/2003 Ishii ..... 34/396
2003/0140751 A1 * 7/2003 McGehee et al. ..... 83/169
2003/0154622 A1 * 8/2003 Aaron ..... 34/306
2003/0182819 A1 * 10/2003 Michon ..... 34/396
2004/0168339 A1 * 9/2004 Roberts et al. ..... 34/218
2004/0171707 A1 * 9/2004 Martel et al. ..... 521/54
2005/0109603 A1 * 5/2005 Graham ..... 201/25
2005/0120715 A1 * 6/2005 Labrador ..... 60/618
2005/0220662 A1 * 10/2005 Hedman ..... 422/1
2005/0223591 A1 * 10/2005 Huard ..... 34/558
2005/0266200 A1 * 12/2005 Padmanabhan ..... 428/54
2005/0283992 A1 * 12/2005 Kettler ..... 34/396
2006/0080856 A1 * 4/2006 Erickson ..... 34/60
2006/0101663 A1 * 5/2006 Perin et al. ..... 34/396
2006/0110499 A1 * 5/2006 Neto ..... 426/129
2006/0112639 A1 * 6/2006 Nick et al. ..... 48/198.1
2006/0168842 A1 * 8/2006 Sprague ..... 34/396
2006/0191158 A1 * 8/2006 Duncan ..... 34/396
2006/0196398 A1 * 9/2006 Graham ..... 110/267
2006/0272172 A1 * 12/2006 Pollard ..... 34/396
2006/0277784 A1 * 12/2006 Cheng ..... 34/397
2006/0278336 A1 * 12/2006 Sundholm et al. ..... 156/312
2006/0280670 A1 * 12/2006 Teeter et al. ..... 423/445 R
2007/0000146 A1 * 1/2007 Boonstra et al. ..... 34/396
2007/0017113 A1 * 1/2007 Scharpf et al. ..... 34/86
2007/0033826 A1 * 2/2007 Seeger ..... 34/396
2007/0044341 A1 * 3/2007 Pollard ..... 34/201
2007/0089805 A1 * 4/2007 Swaan et al. ..... 144/1.1
2007/0130788 A1 * 6/2007 Kunugi ..... 34/202
2007/0173679 A1 * 7/2007 Guyomarc'h ..... 588/321
2007/0187223 A1 * 8/2007 Graham ..... 201/25
2008/0014111 A1 * 1/2008 Hedman ..... 422/3
2008/0022548 A1 * 1/2008 Maynard et al. ..... 34/396
2008/0034681 A1 * 2/2008 McDonald ..... 52/93.1
2008/0155985 A1 * 7/2008 Labrador ..... 60/698
2009/0013596 A1 * 1/2009 Wang ..... 47/17
2009/0071062 A1 * 3/2009 Hedman ..... 43/132.1
2009/0113752 A1 * 5/2009 Weir ..... 34/282
2009/0266081 A1 * 10/2009 Graham ..... 60/780
2010/0058607 A1 * 3/2010 Franich et al. ..... 34/255

FOREIGN PATENT DOCUMENTS

CH 677527 A5 * 5/1991
DE 3120844 A1 * 12/1982
DE 3715511 A1 * 11/1987
DE 4209452 A1 * 5/1993
DE 4202392 A1 * 8/1993
DE 4312189 A1 * 10/1994
DE 19951627 A1 * 7/2000

| | | | | |
|---|---|---|---|---|
| EP | 429947 | A1 | * | 6/1991 |
| EP | 430910 | A1 | * | 6/1991 |
| EP | 447376 | A1 | * | 9/1991 |
| EP | 634648 | A1 | * | 1/1995 |
| EP | 1132701 | A2 | * | 9/2001 |
| EP | 1439359 | A2 | * | 7/2004 |
| EP | 1975531 | A1 | * | 10/2008 |
| FR | 2564850 | A1 | * | 11/1985 |
| FR | 2572170 | A1 | * | 4/1986 |
| FR | 2581743 | A1 | * | 11/1986 |
| FR | 2631432 | A1 | * | 11/1989 |
| GB | 2147400 | A | * | 5/1985 |
| GB | 2183319 | A | * | 6/1987 |
| GB | 2183807 | A | * | 6/1987 |
| GB | 2190179 | A | * | 11/1987 |
| GB | 2273761 | A | * | 6/1994 |
| GB | 2455078 | A | * | 6/2009 |
| JP | 52028055 | A | * | 3/1977 |
| JP | 56027822 | A | * | 3/1981 |
| JP | 62130801 | A | * | 6/1987 |
| JP | 63039309 | A | * | 2/1988 |
| JP | 63070048 | A | * | 3/1988 |
| JP | 01139134 | A | * | 5/1989 |
| JP | 01310287 | A | * | 12/1989 |
| JP | 02098404 | A | * | 4/1990 |
| JP | 02140590 | A | * | 5/1990 |
| JP | 02192584 | A | * | 7/1990 |
| WO | WO 9006840 | A1 | * | 6/1990 |
| WO | WO 9217744 | A1 | * | 10/1992 |
| WO | WO 9415159 | A1 | * | 7/1994 |
| WO | WO 9601401 | A1 | * | 1/1996 |
| WO | WO 9601971 | A1 | * | 1/1996 |
| WO | WO 9611780 | A1 | * | 4/1996 |
| WO | WO 9700412 | A1 | * | 1/1997 |
| WO | WO 9729894 | A1 | * | 8/1997 |
| WO | WO 0159378 | A2 | * | 8/2001 |
| WO | WO 0178955 | A2 | * | 10/2001 |
| WO | WO 02065038 | A1 | * | 8/2002 |
| WO | WO 03106126 | A1 | * | 12/2003 |
| WO | WO 2004099692 | A1 | * | 11/2004 |
| WO | WO 2005052478 | A1 | * | 6/2005 |
| WO | WO 2007083863 | A1 | * | 7/2007 |
| WO | WO 2007083864 | A1 | * | 7/2007 |
| WO | WO 2007130058 | A1 | * | 11/2007 |

* cited by examiner

DUAL PATH KILN

CROSS-REFERENCE TO RELATED APPLICATIONS

This application is a Continuation-In-Part of U.S. patent application Ser. No. 11/414,262, filed 1 May 2006 and now abandoned, which claims priority to U.S. Provisional Patent Application No. 60/683,859, filed 23 May 2005.

FIELD OF THE INVENTION

BACKGROUND TO THE INVENTION

Embodiments of the present invention relate to the field of kilns used in the drying of lumber, and more particularly pertains to an improved kiln having a continuous opposing feed and discharge stream at each end of the kiln where the passing of the dried lumber preheats the green lumber.

BACKGROUND

Drying lumber is typically performed in a batch kiln process, where an insulated chamber is used that is adapted to control several drying process conditions, including, but not limited to air temperature in the kiln, air speed across the lumber, and the relative humidity in the chamber. As these kilns are a closed atmosphere, packages of sawn lumber, often referred to as green lumber, separated by stickers are placed in the kiln in batches. The packages are often loaded vertically, horizontally, and end to end.

Once the batch of packages are in place, the chamber is closed and a schedule or recipe of temperatures and relative humidity is initiated for a determined time interval or until a certain moisture content in the lumber is achieved. Generally, the schedule gradually increases the temperature in the chamber and lowers the relative humidity. This allows the lumber to give up its moisture to the surrounding air, which may then be vented to the outside atmosphere.

The particular schedule used and the drying time varies depending on a number of factors, including, but not limited to, lumber type/species, thickness, moisture content, end use of the lumber and the like. Once the schedule has run, the kiln doors are opened and the packages are removed from the kiln chamber and further prepared for shipping to a final destination. This opens the chamber to atmospheric conditions and can often require a significant amount of time and energy to bring the next charge of green lumber up to drying conditions.

While lumber is typically dried as fast as possible depending on the cell structure, drying too rapidly can have adverse affects on the lumber, such as checking, splitting, warping, cupping, and the like. Accordingly, the temperature and humidity in the kiln, as well as the drying time will vary depending on the above listed factors. For example, Red Oak may take up to 28 days dry from green to 7% moisture content, while Southern Yellow Pine can be dried in approximately 20-24 hours from green to 15% moisture content.

DESCRIPTION OF EMBODIMENTS OF THE INVENTION

In the following detailed description, reference may be made to the accompanying drawings which form a part hereof, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Figure 1:
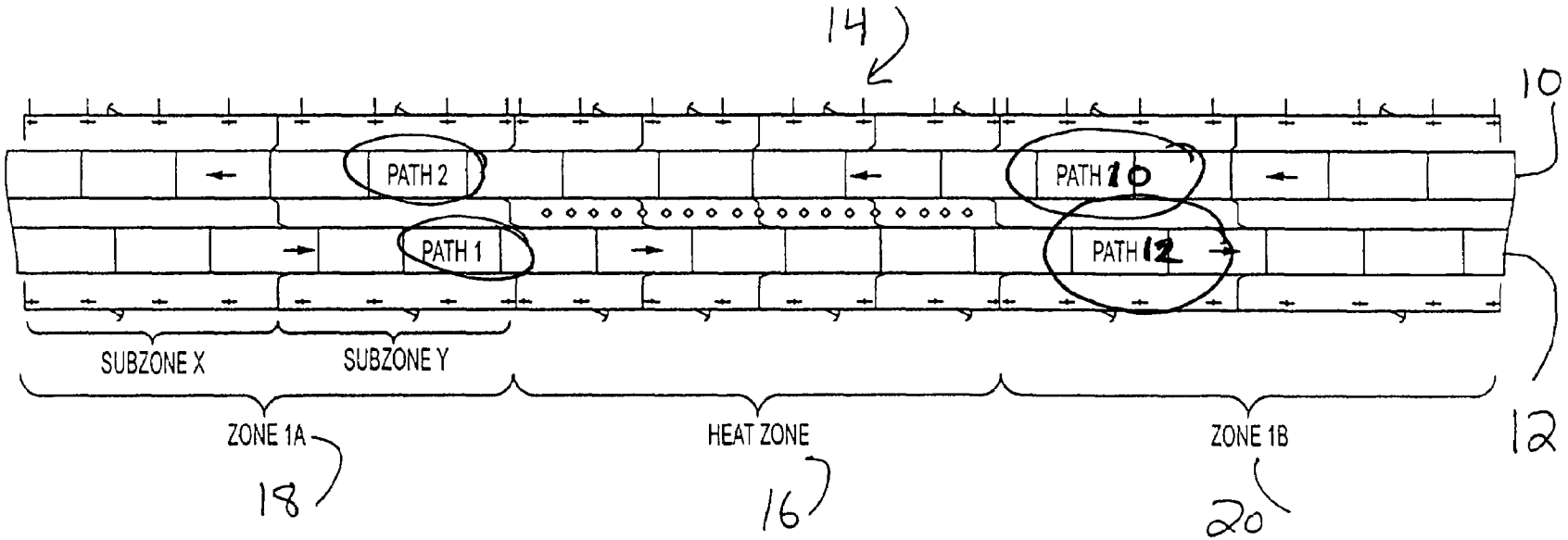
FIG. 1 is a schematic top view of the dual path kiln of this invention.

Embodiments of the present invention are directed to a continuous type lumber drying process, where, in FIG. 1, at least two different opposing paths 10 and 12 move green lumber through a kiln 14 such that a dried lumber charge exits a first end of the kiln while a green lumber charge enters the first end. Embodiments allow for the heat dissipating from the dried lumber after exiting a drying chamber to heat or preheat the green lumber, thereby saving time and energy over the batch kiln systems. Embodiments also include the green lumber releasing moisture into the air due to the heating by the dried charge, which cools the air and may assist in conditioning the dried lumber prior to exiting the kiln.

In one embodiment of the present invention, a kiln 14 may include three zones: a primary drying zone 16; and two preheat/conditioning zones 18 and 20, one being coupled to each end of the primary drying zone 16. A dual path configuration may be implemented to convey lumber through the preheat/conditioning zones 18 and 20 and the primary drying zone 16. The dual path of the present invention may convey charges in opposite directions through the kiln, and controllably operate at a rate calculated to ensure that the proper drying of a green charge is achieved from the time it enters the first end 22 and exits the second end 24 of the kiln, and when a green charge enters the second end 24 and exits from the first end 22.

By way of example, and as illustrated in the attached figures, in one embodiment in accordance with the present invention, the preheat/conditioning zones, Zone 1A,18 and Zone 1B,20, and the primary heating chamber, Heat Zone 16 may each be approximately 80 feet long, and coupled together such that a charge path 10 and a charge path 12 may pass through Zone 1A, Heat Zone and Zone 1B in a continuous manner, and in opposite directions. Embodiments of the present invention may include more than two lumber charge paths, and may further include more than three zones.

In operation, one or more of green lumber charges may be positioned to enter Zone 1A on path 12, and one or more dried lumber charges may be positioned in Zone 1A, 18 on path 10, having recently passed through the Heat Zone 16, where the charges were subjected to heated air to facilitate drying. As the green lumber charges on path 12 pass the dried lumber charges of path 10 in Zone 20, the dried charge of path 10 heats the air in Zone 1A,18. This heating effect in turn may heat the green lumber charge of path 12, thereby gradually raising the temperature encountered by the green charge and initiates the drying process of the green lumber charge. Likewise, as the green lumber charge begins to dry, it may release moisture into the air of Zone 1A, 18. This moisture release may cool the air and increase the humidity of the air. This cooler, moister air may then be circulated past the dried lumber charge of path 10 in Zone 1A,18, serving to condition the dried lumber charge exiting the kiln.

It can be appreciated that a similar preheating and conditioning process may occur in Zone 1B 20, but with the dried lumber charge being conveyed on path 12 and the green lumber charge being conveyed on path 10.

Figure 4:
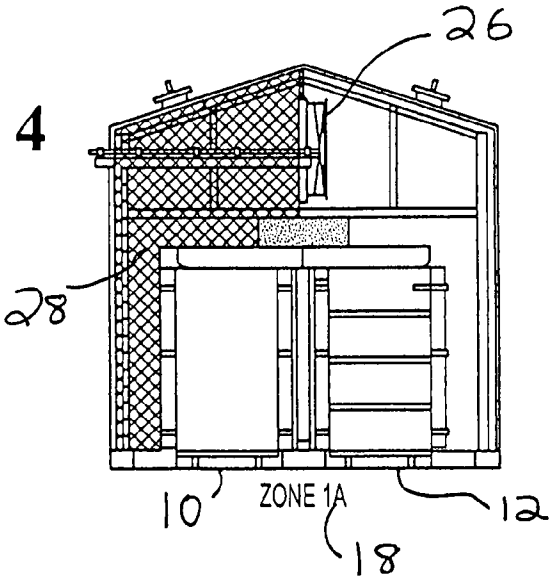
FIG. 4 is a sectional view along lines 4-4 of FIG. 2.

In one embodiment, fans of varying horsepower and position may be distributed in the preheat/conditioning zones to facilitate directing the movement of air between the various lumber charges. For example, fans several of which are indicated at 26 in FIGS. 2-4 may be positioned to circulate air across the dried lumber charge of path 10, and over the green lumber charge of path 12. The air may then circulate around the top and/or bottom of the charges to again be directed over the dried lumber charge of path 10, thereby effecting the heating and conditioning of the green and dry lumber charges respectively.

In one embodiment, the only venting of the kiln is through the open ends of the input/output ends 22, 24 of the preheat/conditioning zones. In other embodiments, one or more vents may be positioned in the preheat/conditioning zones to controllably regulate the temperature and manage any condensation or moisture congregation that may occur.

Figure 2:
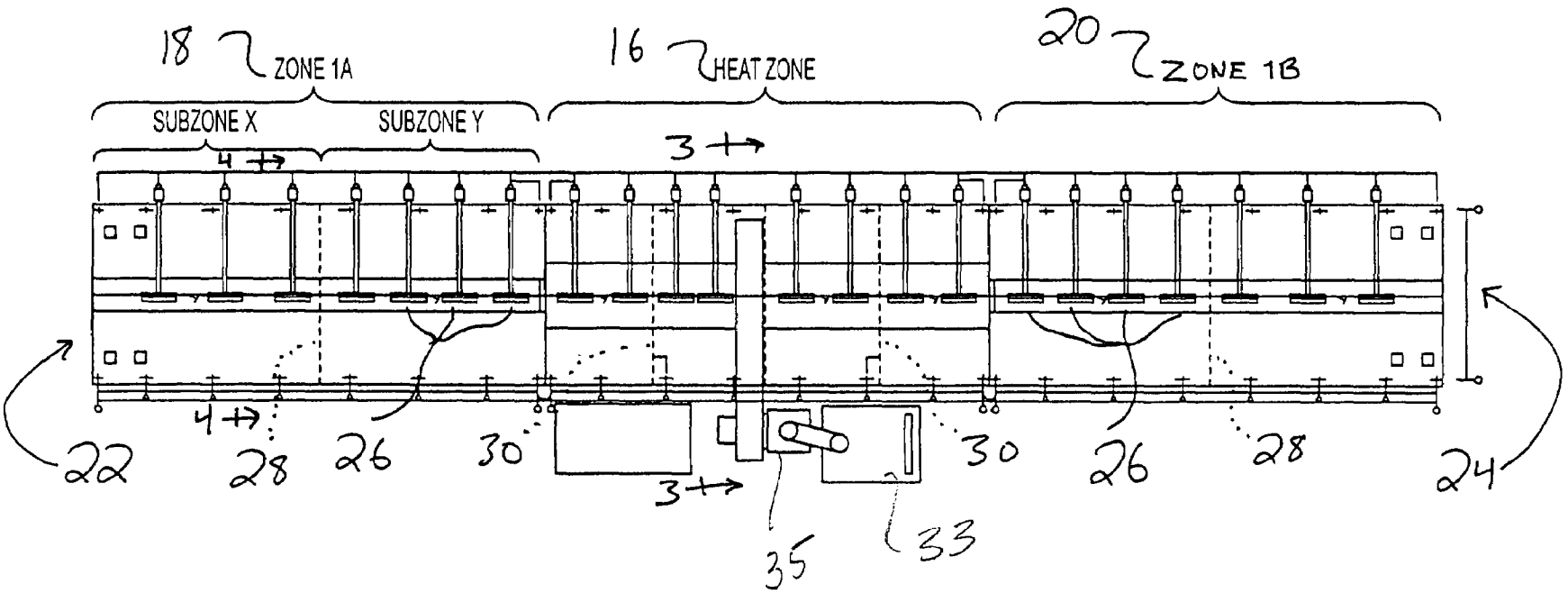
FIG. 2 is a view similar to FIG. 1 but showing more detail.
Figure 3:
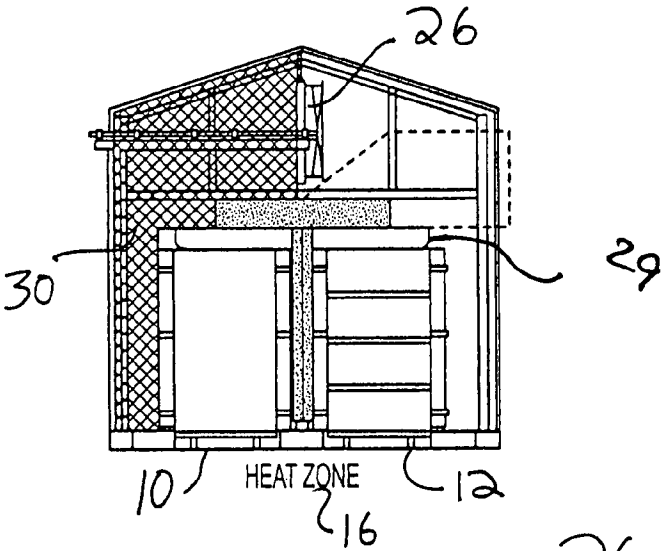
FIG. 3 is a sectional view along lines 3-3 of FIG. 2.
Figure 5:
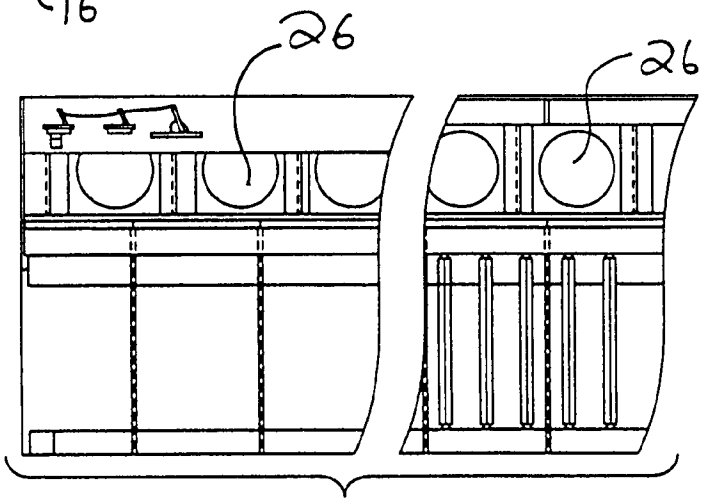
FIG. 5 is a side view of sections of the invention of FIG. 4.

In one embodiment of the present invention, baffles or other partitions , as indicated in broken lines 28 in FIG. 2, may be used to not only divide the kiln heat zone from the preheat/conditioning zones, but to also further divide the interiors of the zones themselves. For example, Zone 1A, 18 may be divided into two sub-zones X and Y. Such further divisions may lead to more efficient preheating and conditioning of the lumber charges and enhance the gradual preheating and conditioning of the green and dried lumber charges respectively. Such sub-zones may also may facilitate temperature regulation within the individual heat zones and resist migration of air having a higher moisture content from moving from one sub-zone to another.

In other embodiments, the Heat zone may be multiple zones having heating elements of varying sizes to further control the gradual heating of the green lumber as it passes through the heat zones. Baffles or partitions, as indicated in broken lines 30, may also be disposed between the various heat zones to facilitate temperature regulation within the individual heat zones and resist migration of air having a higher moisture content from one heat zone to another.

In one embodiment, different horsepower/sized fans may be used in different zones or sub-zones to controllably vary the rate of air flow across the lumber charges. The baffles 28, 30 may help prevent migration of air velocity and help maintain air differentials between the zones, where different horsepower fans are being used for example. In one embodiment, the higher air velocity is generated in the zones at or near the center of the kiln. The air velocity may be gradually reduced in the zones towards the entry/discharge ends of the kiln.

In various embodiments, the travel time of the lumber charges may vary depending on many of the same factors affecting the batch kiln process. When using a continuous drying process in accordance with embodiments of the present invention, it is anticipated that the length of time for a charge to pass through the kiln and be dried to a desired moisture content will take no longer than the typical batch kiln process for analogous species and dimensions. It is preferred that the rates the charges pass through the kiln are equal but opposite in direction. The rate, however, may be varied collectively or independently depending on the rate of drying for a particular charge. Accordingly, in one embodiment, the moisture content of the lumber charges being dried is monitored, and the flow rate may be altered as needed to ensure the dried lumber charges exits the kiln at the proper moisture content.

In one embodiment, for example, when drying Southern Yellow Pine, the rate of movement of the lumber charges through the kiln may be equal on path 10 and path 12, and may be in the range of approximately 0.05-0.5 ft/min, and utilize a heating element having a rating in the range of 15-35 million BTU/hr. Again, the rate and heat source may vary depending on the factors identified above.

The overall throughput may be greater in a kiln in accordance with embodiments of the present invention, as the charges are continuously being processed as opposed to the batch kilns where once a drying cycle is complete, the charges must be removed and new charges loaded. Throughput will also be greater than a traditional kiln with the same size heat system, due to the use of heat from a dried lumber charge to heat the green lumber charge. This may further lead to reduced energy use, as the preheating of the green charges prior to entry into the primary heating chamber, or heat zone, can reduce the size or output of the heat source, for example. Further efficiency may be realized as the heat zone does not need to be cooled to the outside temperature every time a drying cycle is complete and a new charge must be loaded. Further, kilns in accordance with embodiments of the present invention may run at a constant dry bulb and relative humidity, which simplifies the various process controls.

In addition to the discussion of various embodiments above, figures and additional discussion are presented herein to further describe certain aspects and various embodiments of the present invention. It is to be understood, however, that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein.

What is claimed is:

1. A method of heat treating lumber using an elongated kiln chamber comprising a first end and a second end and having at least two zones including a heating zone and a heat transfer zone with said zones being adjacent and each including a first path of travel and a second path of travel for separate lumber charges, comprising the steps of feeding one charge of lumber through the heating zone at a selected speed while feeding another charge of lumber through the heat transfer zone, selecting the speed of movement of each charge so that, in the heat transfer zone, at least a portion of the heat carried by said one charge of lumber will be transferred to said another charge before said another charge enters the heating zone wherein said first oath includes a first inlet being located at said first end and a first outlet being located at said second end and said second path includes a second inlet being located at said second end and a second outlet being located at said first end and wherein said first inlet is disposed adjacent said second outlet.

2. The method as claimed in claim 1 wherein said chamber has two paths of travel through the chamber and including the step of moving the charges of lumber along said two paths with one charge being moved in one direction and the other charge being moved in a direction opposite to said one direction.

3. An apparatus for treating lumber comprising an elongated chamber comprising a first end and second end and having an upper wall and side walls depending from said upper wall and surrounding a heating zone having opposite ends and a first and second heat transfer zone with said heat transfer zones being located at a said end of said heating zone, each of said zones having first and second paths for moving separate charges of lumber along said paths in opposite directions so that a charge of lumber entering said first end of said chamber will pass through said first heat transfer zone and then through said heating zone and then through said second heat transfer zone to transfer heat to a charge of lumber entering said second heat transfer zone wherein said first path includes a first inlet being located at said first end and a first outlet being located at said second end and said second oath includes a second inlet being located at said second end and a second outlet being located at said first end and wherein said first inlet is disposed adjacent said second outlet.

4. The apparatus as claimed in claim 3 wherein fans are provided to move heated air through said zones to transfer a portion of the heat from a charge of lumber leaving said heating zone to a charge of lumber entering a heat transfer zone.

5. The apparatus as claimed in claim 4 wherein said fans are mounted adjacent said upper wall.

6. The apparatus as claimed in claim 3 wherein said first and second paths extend parallel to one another.

7. The apparatus as claimed in claim 6 wherein said paths are separated by a wall along at least a portion of said paths.

8. The apparatus as claimed in claim 3 wherein said paths are separated by a wall along at least a portion of said paths.

9. The apparatus as claimed in claim 3 wherein said conveyor apparatus includes a pair of rails and carts having wheels supported on said rails.

10. The apparatus as claimed in claim 9 wherein a pusher device is provided at an end of the rails to move the carts along the rails into and through the zones in said apparatus.

11. The method according to claim 1, further comprising preventing migration of air having a higher moisture content in the heat transfer zone to the heating zone.

12. The method according to claim 1, further comprising using a fan to circulate a cooler and increased humidity air from green lumber the charge entering the heating zone to hot dry lumber in the charge leaving the heating zone to cool and condition the hot dried lumber.

13. The method according to claim 1, wherein the first and second paths of travel are opposite and parallel one another in the heat transfer zone.

14. The method according to claim 1, wherein the lumber is fed on a conveyor apparatus comprising a pair of rails and carts having wheels supported on the rails.

15. The method according to claim 14, wherein the carts are moved by a pusher device.

16. The method according to claim 1, the kiln further comprising a conditioning zone and the method further comprising feeding the lumber through the conditioning zone.

17. The method according to claim 1, further comprising only venting the kiln through the heat transfer zone.

18. The method according to claim 17, wherein the venting occurs through an open end of the heat transfer zone.

19. The method according to claim 17, wherein the venting occurs through at least one vent in the heat transfer zone.

20. The method according to claim 17, wherein the venting is used to control at least one of a temperature, moisture or condensation in the heat transfer zone.

21. The method according to claim 1, further comprising using a baffle to divide the heat transfer zone from the heating zone.

22. The method according to claim 1, wherein rates the lumber passes through the kiln on the first and second paths is equal but opposite in direction.

23. The method according to claim 1, wherein the lumber passes through the kiln at a rate of 0.05 to 0.5 ft/min when using a heating element having a rating of 15 to 35 million BTU/hr.

* * * * *

UNITED STATES PATENT AND TRADEMARK OFFICE

CERTIFICATE OF CORRECTION

PATENT NO. : 7,963,048 B2
APPLICATION NO. : 11/525929
DATED : June 21, 2011
INVENTOR(S) : Pollard It is certified that error appears in the above-identified patent and that said Letters Patent is hereby corrected as shown below:

Column 4, line 13 of claim 1, and in line 15 of claim 3, the term "oath" should be replaced with "path".

Column 4, line 54 should read "wherein said first path includes a first inlet being located at" and Column 5, line 13, should read "outlet being located at said second end and said second path".

Signed and Sealed this
Seventh Day of February, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,963,048 B2
APPLICATION NO. : 11/525929
DATED : June 21, 2011
INVENTOR(S) : Pollard It is certified that error appears in the above-identified patent and that said Letters Patent is hereby corrected as shown below:

The "Related U.S. Application Data", under section (63) on the first page of this Letters Patent, is incomplete. Please have section (63) read as follows:

Continuation-In-Part of application No. 11/414,262, filed on May 1, 2006, now abandoned, which claims priority to U.S. application No. 60/683,859, filed on May 23, 2005.

Signed and Sealed this
Thirteenth Day of March, 2012

David J. Kappos

David J. Kappos
*Director of the United States Patent and Trademark Office*